US010113277B2

(12) United States Patent
Charnenka et al.

(10) Patent No.: US 10,113,277 B2
(45) Date of Patent: Oct. 30, 2018

(54) DEVICE FOR AUTOMATIC RE-STRIPING OF HORIZONTAL ROAD MARKINGS

(71) Applicant: OOO "STiM", Brest (BY)

(72) Inventors: Dzmitry Charnenka, Brest (BY); Viktar Arkesau, Brest (BY)

(73) Assignee: OOO "STiM", Brest, OT (BY)

( * ) Notice: Subject to any disclaimer, the term of this patent is extended or adjusted under 35 U.S.C. 154(b) by 0 days.

(21) Appl. No.: 15/366,965

(22) Filed: Dec. 1, 2016

(65) Prior Publication Data

US 2018/0155884 A1 Jun. 7, 2018

(51) Int. Cl.

| | |
|---|---|
| ***E01C 23/16*** | (2006.01) |
| ***B05B 13/00*** | (2006.01) |
| ***B05B 3/14*** | (2006.01) |
| ***E01C 23/20*** | (2006.01) |

(52) U.S. Cl.

CPC ..... *E01C 23/163* (2013.01); *B05B 3/14* (2013.01); *B05B 13/005* (2013.01); *E01C 23/20* (2013.01)

(58) Field of Classification Search

None

See application file for complete search history.

(56) References Cited

U.S. PATENT DOCUMENTS

2013/0190981 A1* 7/2013 Dolinar ..... B60R 11/04 701/41
2016/0209511 A1* 7/2016 Dolinar ..... G01S 19/14
2016/0356005 A1* 12/2016 Dolinar ..... G06K 9/00798

* cited by examiner

*Primary Examiner* — Jethro M. Pence

(74) *Attorney, Agent, or Firm* — Nadya Reingand; Yan Hankin

(57) ABSTRACT

A device is provided for automatic re-striping of horizontal road markings and which can be mounted on a vehicle. In one embodiment the device comprises a marker unit with a linear actuator, an electronic control unit electrically connected to the linear actuator, wherein the electronic control unit comprises an electronic gyroscope which can determine an angular speed of the vehicle on curved road sections, and a laser scanner mounted in front of the marker unit. In some embodiments the electronic control unit is configured to calculate and offset, based on the angular speed of the vehicle, for additional deviation of the paint guns from the coordinates of any of the previous marking lines when the vehicle moves on curved road sections.

12 Claims, 4 Drawing Sheets

DEVICE FOR AUTOMATIC RE-STRIPING OF HORIZONTAL ROAD MARKINGS

This invention is concerned with mechanical engineering and relates to road construction/repair machinery and auxiliary equipment and specifically to devices for applying horizontal road markings when refreshing old road markings.

A device for application of longitudinal road markings is known that can also be used for automatic re-striping of horizontal road markings [1, Patent EP0643171. Means for spraying longitudinal road markings. IPC E01023/163, priority 13 Sep. 1993, published on 15 Mar. 1995]. It comprises a marker unit assembly connected with a far-sighting system and a near-sighting system, which assembly can be mounted to a vehicle.

The marker unit comprises spray guns secured on the carriage and equipped with means for controlling their opening and closure, and a linear actuator for the positioning of the carriage in a direction transverse to the direction of vehicle travel, in order to guide the spray guns to the road marking lines to be refreshed.

A suspension is provided between the marker unit and the vehicle frame to lift the marker unit to the transportation position and press the support wheel of the marker unit to the road surface to keep the spray guns at a constant height with respect to the road surface during marking.

The far-sighting system is designed to identify the markings and determine the positions, the breadths and the lengths of the marking lines located in the distance from the marker unit. It defines approximated positions of the horizontal marking lines and comprises the first video camera installed in the front of the vehicle which is capable of identifying markings simultaneously on the left and right of it, and the first image processing electronic device.

A near-sighting system is intended to adjust the marking line coordinates that the far-sighting system identified. The near-sighting system determines the marking line coordinates near the marker unit and comprises the second video camera located close to the marker unit and the second image processing electronic device. The second video camera can move horizontally as one with the spray guns.

An electronic control unit is installed on the vehicle to control the linear actuator and the means for opening and closure of the spray guns.

The linear actuator controlled by the electronic control unit puts the spray guns in a position corresponding to the marking line coordinates determined by the far-sighting system and adjusted by the near-sighting system. The control unit also sends signals to the means for opening and closure of the spray guns.

The said known device [1] has significant drawbacks:

- The far-sighting and near-sighting systems use video cameras to identify and determine the position of the lines that are to be restriped. The video cameras are affected by ambient light and do not allow accurate determination of the marking line coordinates;
- Video cameras determine the marking line coordinates with an accuracy of less than 50 mm, whilst standards in most countries require accuracy of 5-10 mm. For this reason, said device [1] patented 22 years ago has not received wide practical application;
- The near-sighting system video camera intended for determining the marking line coordinates near the spray guns is mounted on the movable carriage and moves vertically and horizontally as one with the spray guns;

- Frequent and irregular movements of the video camera resulting from transversal movements of the linear actuator prevent accurate determination of the marking line coordinates.

The above-mentioned drawbacks are eliminated in the system for automatic re-striping of horizontal road markings [2 New Technologies in Road Markings//Highways. Monthly information and analytical magazine. No. 3 (964), pp. 54-56] and [3, New marking technologies being developed. http://www.worldhighways.com/categories/road-markings-barriers-workzoneprotection/features/new-marking-technologies-being-developed/. Access Date 27 Oct. 2016], which design has found practical use in the LIS prototype unit [4, LIS Automatic Re-Striping Unit. Operating Manual SDTI L-007.00.00.000 RE] produced and distributed by Private Unitary Company "Construction Machinery and Materials" (StiM) according to the Belarusian specifications [5, LIS Automatic Re-Striping Unit. Specifications TU BY 200647886.024-2007].

This prototype [4] comprises a vehicle-mounted marker assembly and a near-sighting system that uses a laser scanner with modulated output, rather than a video camera as the analogue [1]. The laser scanner is fixed to the vehicle body at a short distance from the front of the marker unit. The near-sighting system comprises the laser scanner and an electronic computation unit, determines the coordinates of the marking lines near the spray guns and automatically generates spray gun opening or closure signals. This system is not affected by ambient light and ensures a reasonably accurate determination of the marking line coordinates near the spray guns.

However, the prototype [2] has a drawback of the low efficiency due to poor re-striping accuracy on difficult road sections.

The fact is that when a vehicle moves along a curved path during re-striping, an additional lateral spray gun deviation occurs from the marking lines that are being re-striped, due to the geometrical position of the laser scanner and the spray guns in relation to the vehicle rear axle. This deviation can be as high as 150 mm, which is significantly higher than standard tolerances.

Another drawback of the prototype [2] is that it does not show adequate re-striping performance at a high vehicle speed or with badly damaged marking lines.

The reason is that the laser scanner secured near the marker unit cannot identify the road marking type or estimate the position and condition of road markings up ahead, before the scanning zone. Since the near-sighting system in the prototype device [2] is only able to detect the deviation of the approaching marking from the spray gun position at a short distance from the marker unit, the linear actuator at the vehicle speed higher than 10 km/h does not have time to guide the spray guns to the line markings that are to be re-striped.

Moreover, this near-sighting system is unable to reliably identify and automatically toggle between spray gun operation modes depending on the marking type (one or two line re-striping; which side of the double line is solid and which is dashed). Further, the near-sighting system is not able to identify and correct wrong or badly damaged old markings.

The challenge of re-striping is that new lines must be applied accurately on the old markings while the vehicle moves at high speed. At the same time, very stringent requirements of national road marking standards must be strictly followed.

During the conventional re-striping procedure, the marking machine driver must visually position spray guns in relation to the marking lines with pinpoint accuracy, while the operator must, with the same pinpoint accuracy, open or close spray guns by visually defining the beginning and end of the line dash. With the existing methods, the re-striping speed generally does not exceed 8 to 10 km/h. Marking quality often does not meet the customer's requirements. Moreover, the operator and the driver quickly get tired, which further reduces productivity.

These drawbacks of the prototype [4] prevent it from performing quality re-striping of road markings at high speeds and on curved road sections in a fully automatic mode without the operator's control.

The object of the invention is to improve operation quality of the device for automatic re-striping of horizontal road markings by creating a device that will allow, at a high speed and with high accuracy, meeting stringent national horizontal road marking standards, completely automating the re-striping process and performing re-striping on straight and curved road sections regardless of the illumination.

The problem is solved in that the device for automatic re-striping of horizontal road markings, comprising a marker unit (1) with a linear actuator (7), which linear actuator is intended to position the spray guns (4,5) secured to the movable carriage (6) on the old marking lines to be restriped; with the linear drive (7) is electrically connected to an electronic control unit (14), which electronic control unit (14) is also electrically connected to a modulated-beam laser scanner (2) positioned in front of the marker unit (1) and capable of identifying coordinates of the marking lines (22) close to the spray guns; the electronic control unit (14) can automatically generate signals to open or close the spray guns (4,5), has the following distinctive features: the electronic control unit (14) is equipped with an electronic gyroscope (19) to determine the vehicle angular speed.

Introduction of such a distinctive feature as an electronic gyroscope (19) to determine the vehicle angular speed would allow the electronic computation module of the control unit (14) to calculate and offset for the additional spray gun deviation from re-striped lines resulting from driving on curved road sections.

Additional features of the invention, aimed at increasing its effects:

the device is additionally provided with at least one digital video camera (20) with an electronic image stabilization function, which is located in the front of the vehicle (3). The video camera captures the image of a stretch of the road surface before the laser scanning (2) area.

Introduction of a digital video camera (20) secured in the front of the vehicle (3) would allow identifying marking lines (22) and determining necessary operating parameters:

Approximate coordinates of the marking lines to be restriped;

Lengths and breadths of the marking lines to be re-striped;

Lengths of gaps between dashes.

The digital video camera (20) is connected to an image processing module (17) which module is a part of the electronic control unit (14) intended to process images, identify and determine coordinates of the markings.

The addition, as a whole, of the electronic gyroscope and the digital camera-based far-sighting system to the design allows fast automatic re-striping of any marking type with a wear rate up to 90%; automatic correction of defects and errors in the old marking; re-striping of difficult road sections while maintaining required accuracy and ensuring automated operation, regardless of illumination conditions.

The exact nature of the invention will become apparent by reference to the drawings, where:

FIG. 1 schematically shows the device for re-striping of horizontal road markings mounted on a vehicle;

Figure 4:
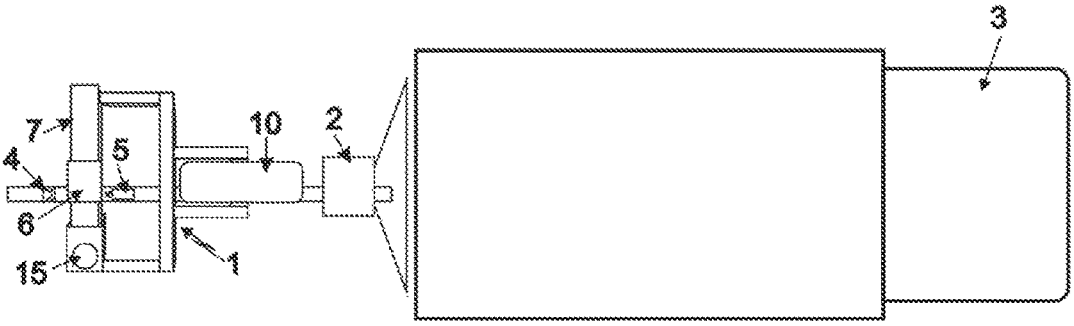
Figure 5:
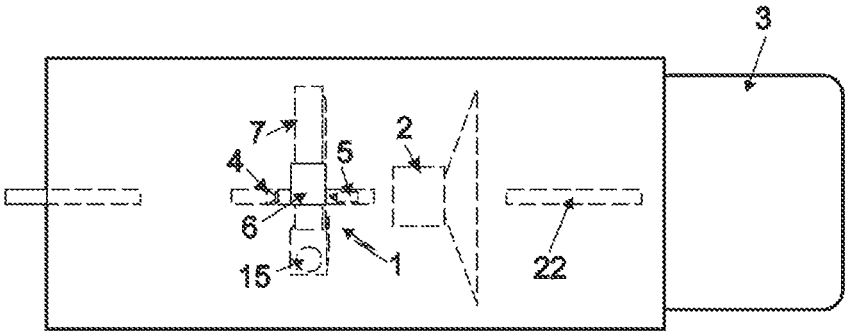
Figure 6:
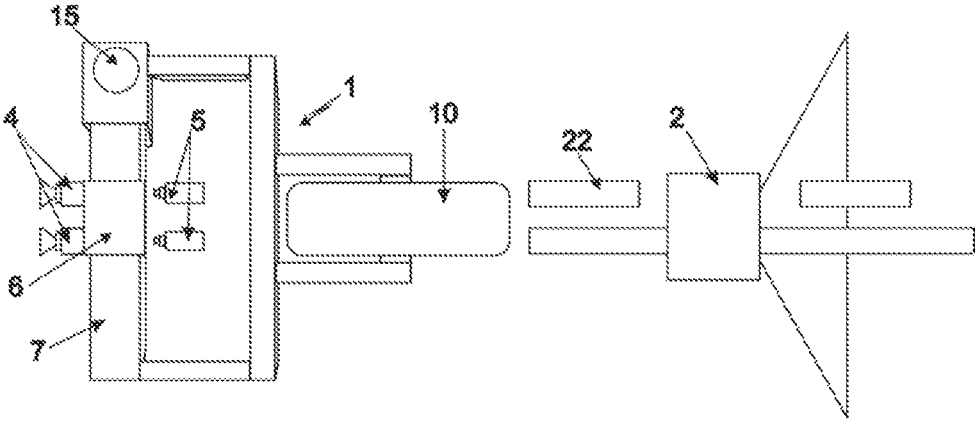
Figure 7:
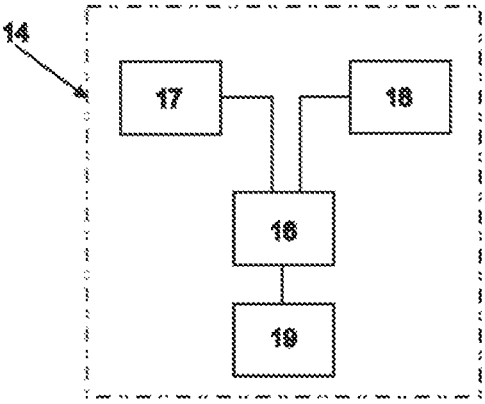
Figure 8:
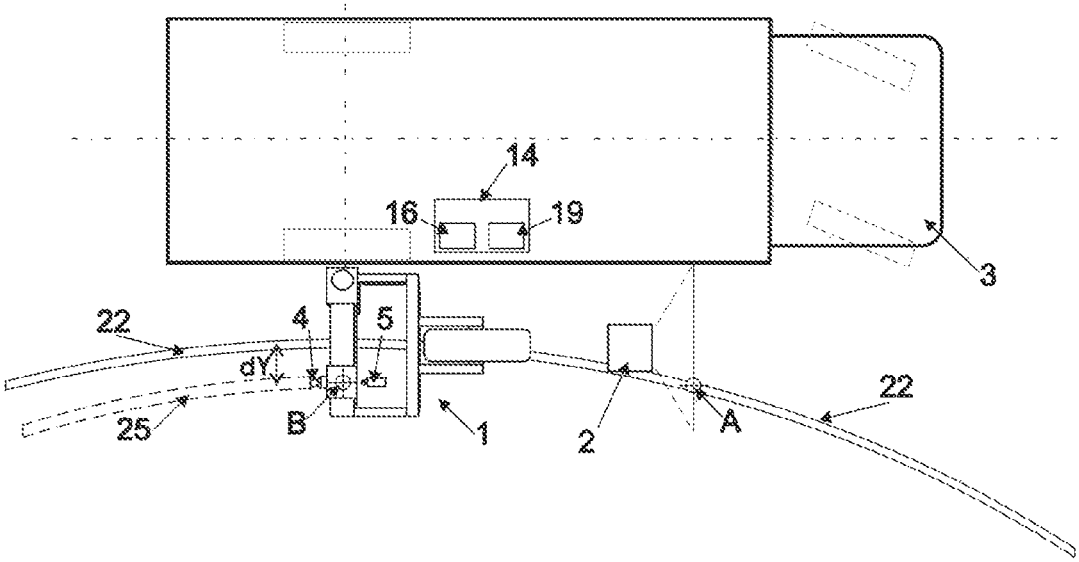

FIG. 4 demonstrates an option to install the marker unit behind the vehicle;

FIG. 5 shows an option to install the marker unit in the middle under the vehicle 3;

FIG. 6 shows an enlarged view of the marker unit of the device;

FIG. 7 demonstrates a functional diagram of the electronic control unit;

FIG. 8 shows deviation of the spray guns 4, 5 from the marking line to be restriped 22 with the vehicle moving in a arc, without being adjusting with the gyroscope.

Figure 1:
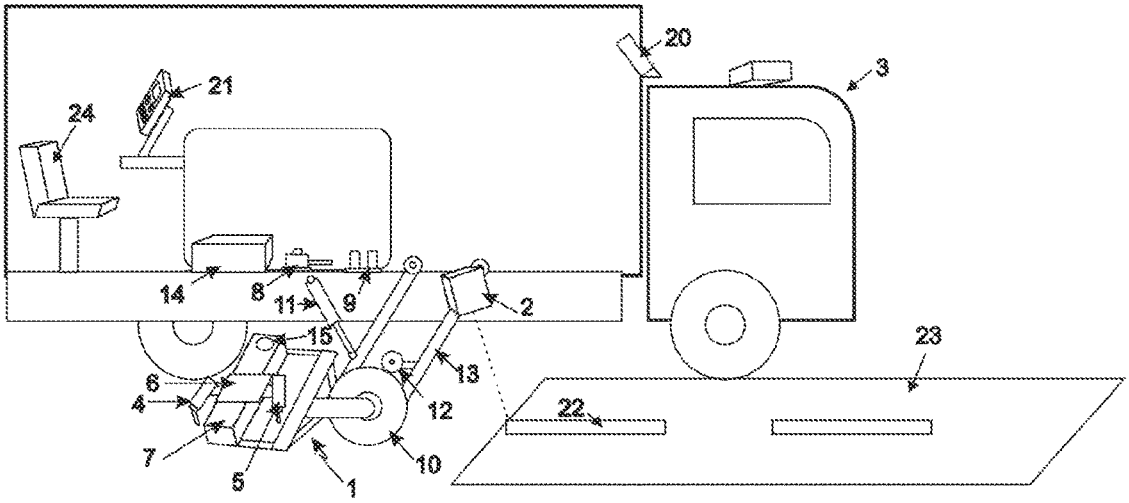

The device for automatic re-striping of horizontal road markings comprises (FIG. 1) a marker unit 1 and the laser scanner 2 located in front of it, which is electrically connected (not shown) to the control unit 14.

Figure 2:
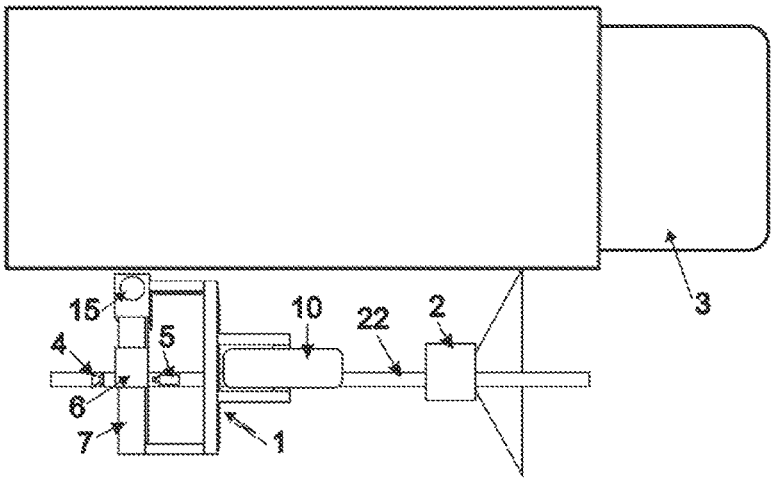
FIG. 2 shows a top view A of FIG. 1.
Figure 3:
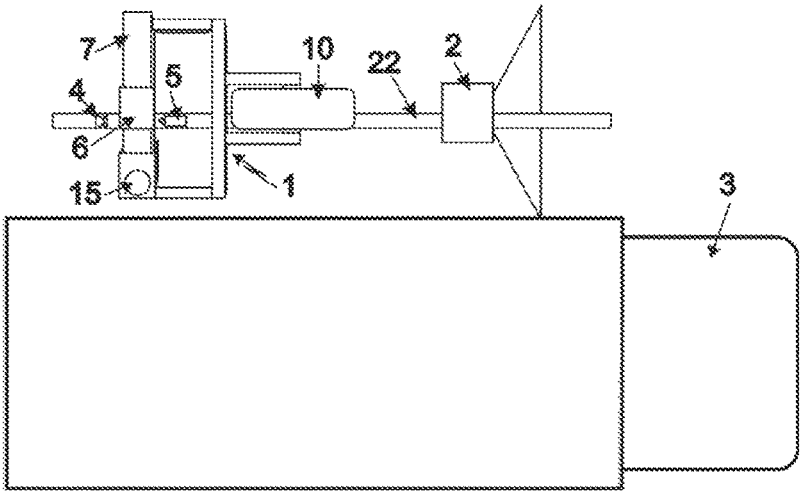
FIG. 3 shows an option to install the marker unit on the left side of the vehicle.

The marker unit 1 is a carriage which is secured to the vehicle body 3. The marker unit 1 can be located on the right (FIG. 1, 2) in the direction of travel of the vehicle 3, or on the left (FIG. 2), or behind the vehicle 3 (FIG. 4), or in the middle of under the vehicle 3 (FIG. 5). Two marker units 1 can be used at the same time (not shown).

The design of the carriage allows folding it in the transport position, when its parts do not extend beyond the vehicle 3, or unfold it into the operating position to mark centerlines or edge lines.

The marker unit 1 is equipped with at least one spray gun 5 (for paint, plastic etc.) and at least one retroreflective bead gun 4.

The said spray guns 4 and 5 are mounted on the carriage 6, which moves in a transverse direction by the linear actuator 7 (for example, hydraulic or electric). The linear actuator 7 is provided with a linear actuator 7 control unit 8 mounted on the vehicle 3. For example, a proportional control valve or an electric servomotor can be used.

Also, more than one spray guns 4 and 5 can be used.

Solenoid valves 9 are used for opening and closing the spray guns. They can be mounted, for example, on the marker unit (not shown) or the vehicle 3.

The marker unit carriage has a support wheel 10 which is pressed against the road surface by the pneumatic cylinder 11 so that the spray guns 4, 5 are kept at a constant height above the road surface and repeat the road surface pattern to ensure constant marking line width.

There is a variety of location options for the speed sensor 12. In the example (FIG. 1), the speed sensor is fixed to one end of the rod 13 and is in contact with the support wheel 10. The laser scanner 2 can be fixed to the other end of the rod 13.

The speed sensor 12 is designed to generate electrical pulses which are transmitted to the electronic control unit 14; pulses are generated at a frequency proportional to the vehicle speed 3.

The electronic control unit 14 is mounted in the vehicle body 3 and is also electrically connected (not shown) with the linear displacement transducer 15 of the linear actuator 7.

The laser scanner 2 mounted in front of the marker unit 1 can emit modulated laser output and is also electrically connected (not shown) with the electronic control unit 14, which is capable of automatically generating signals to open or close spray guns 4 and 5. For this purpose, the electronic control unit 14 comprises (FIG. 7) an electronic computation module 16 (e.g. ECM-1 type), a video signal processing module 17 (e.g. VPM-1 type), a monitoring and control module 18 (e.g. MCU-1), and an electronic gyroscope 19 to determine the angular speed of the vehicle 3.

The electronic computation module 16 (ECM-1) implements the basic data processing algorithm for the far-sighting and near-sighting system data, processes the signal from the electronic gyroscope 19, calculates the dY offset, and calculates the signal value to control the linear actuator 7 and the signal values to control the spray guns 4, 5.

The video signal processing module 17 (VPM-1) processes data coming from the digital far-sighting video camera 20 (or several such cameras) located in front of the vehicle 3, determines the type of marking to be refreshed and determines the marking line coordinates.

The monitoring and control module 18 (MCU-1) processes signals from the linear displacement transducer 15 of the linear actuator 7 and signals from the speed sensor 12, and comprises a driver for the linear actuator 7 control and a driver for the solenoid valves 9 control.

The function of the electronic gyroscope 19 is shown in FIG. 8. When the vehicle moves along a curved path, in particular along a circular arc, while re-striping the old markings 22, the Point B (center of the spray guns 5 and 6) trajectory does not match the Point A (center of the old markings to be re-striped 22 trajectory on the laser scanning line). Additional deviation of the spray guns and thus new line markings, from the marking line to be re-striped is the dY. Its value depends on the variable angular speed Ω of the vehicle, as well as the constant K determined by the position of the spray guns and the laser scanner with respect to the rear wheels axle while the vehicle moves along the circular arc.

Similarly to the additional deviation dY of the spray guns as described above, there is even more significant deviation of the spray guns from the old marking lines to be re-striped defined by the far-sighting video camera located in the front of the vehicle.

The electronic gyroscope 19 determines an angular speed Ω of the vehicle 3, which allows the electronic computation module 16 of the electronic control unit 14 to determine and offset the additional deviation dY of the spray guns 4, 5 from the marking lines when driving on curved road sections.

The electronic control unit 14 is electrically connected (not shown) with the control terminal 21 mounted on the vehicle 3. The control terminal 21 enables manual toggling between the control modes of the electronic control unit 14, as well as setting and monitoring parameters of the device depending on the condition of the existing road markings and the vehicle configuration 3.

Further, the digital video camera 20 (or several such video cameras) are connected to the video signal processing module 17, which may be incorporated into the control unit 14 to process images, further identify the existing road markings, and determine the marking line coordinates 22 in the plane of the road surface 23 located in front of the laser scanner 2.

The control terminal 21 may be installed, for example, in the vehicle body 3 in front of the operator's seat or in the cab of the vehicle 3 (not shown) to be controlled directly by the driver. The control terminal 21 is electrically connected to the electronic control unit 14 via a field bus (not shown).

The control terminal 21 toggles between operation modes depending on the operating conditions and configuration of the vehicle 3 and sets and monitors operating parameters of the marker unit 1. The control terminal 21 comprises a display (not shown) to display customized settings and necessary controls (not shown) to set parameters and control the marker unit 1. In addition to the main (re-striping) mode, the terminal enables applying a new standard marking to the parts of the road with missing or almost totally damaged (over 90%) marking lines.

The principle of operation of the device for automatic re-striping of horizontal road marking is described below.

Based on the information received from the digital far-sighting video camera 20, the laser scanner 2, which relates to the near-sighting system, speed sensor 12 and the linear displacement transducer 15 of the linear actuator 7, the electronic computation module 16 (ECM-1) in the electronic control unit 14 (FIG. 7) determines the displacement error (dE) of coordinates of the spray guns 4, 5 and the marking line coordinates determined by the laser scanner 2. Based on the displacement error (dE), the electronic computation module 16 (ECM-1) generates signals to control the linear actuator 7 (FIG. 1), and the linear actuator puts the carriage 6 with a fixed set of spray guns 4, 5 in the position corresponding to the marking line 22 at a rate proportional to the magnitude of the said error (dE). Also (FIG. 7), the electronic computation module 16 (ECM-1) determines the start and end (FIG. 1) of each marking dash 22 based on the data received from the laser scanner 2. The start and end signals of the marking 22 are used (FIG. 7) by the monitoring and control unit 18 (MCU-1) to enable or disable (FIG. 1) solenoid valves 9 which control the spray guns 4, 5.

When the vehicle 3 moves on curved road stretches, the electronic gyroscope 19 generates a signal proportional to the vehicle angular speed. As a result of the signal processing (FIG. 7), the electronic computation module 16 (EMC-1) adjusts the coordinates dY (FIG. 8) of the linear actuator 7 to offset the additional deviation trajectory of the spray guns 4, 5 from the marking line trajectory which occurs when driving on a curved stretch due to geometry location of the spray guns 4, 5 and the laser scanner 2 with respect to the rear axle of the vehicle 3.

A combination of the far-sighting system based on the digital video camera 20, which records a road stretch in front of the laser scanner and determines the type and approximate location of far marking lines; the near-sighting system based on the laser scanner 2, which can accurately determine the coordinates of the marking lines 22 near the marker unit 1 at any ambient light (or with no light at all) and a high speed; the gyroscope 19 that determines the vehicle angular speed to offset for additional deviation of the spray gun from the marking lines to be re-striped when driving on curved road sections; a high performance (FIG. 7) electronic computation module 16 ECM-1, which performs the main software algorithm, allows identification and automatic re-striping (FIG. 1) of old markings 5 to 40 cm wide, with a wear rate of up to 90% at a speed of 3 to 40 km/h under any lighting conditions.

Implementation of this invention will allow:

- Automatic non-stop re-striping of any marking types at night and in bright sunlight, with a markings wear rate of up to 90%;
- Automatic correction of defects and errors of old markings;
- Perform high quality re-striping both in straight and curved road sections.

This will ensure quality re-striping in an automatic mode, without major control of the operator, at the marking machine speed of up to 40 km/h, which will make re-striping 1.5-3 times faster while complying with regulatory requirements. Reducing the marking time will significantly reduce the accident rate and cut costs.

INFORMATION SOURCES

1. Patent EP0643171. Means for spraying longitudinal road markings. IPC E01C23/163, priority on 13 Sep. 1993, published on 15 Mar. 1995
2. New technologies in road markings//Highways. Monthly information and analytical magazine. No. 3 (964), pp. 54-56. (Новые техноло гии в дорожной разметке Автомо бильные дороги Ежемеся чный информ ационнс анали тический курнал. No 3 (964), стр. 54-56.)
3. New marking technologies being developed. Electronic resource http://www.worldhighways.com/categories/road-markings-barriersworkzone-protection/features/new-marking-technologies-being-developed/. Access Date Oct. 27, 2016.
4. LIS Automatic Re-Striping Unit. Operating Manual SDTI L007.00.00.000 RE/prototype/.
5. LIS Automatic Re-Striping Unit. Specifications TU BY 200647886.024-2007/

What is claimed is:

1. A device for automatic re-striping of horizontal road markings and which can be attached to a vehicle, the device comprising:

a marker unit with a linear actuator which is configured to position paint guns secured to a movable carriage over previous marking lines to be restriped, the linear actuator comprising a linear displacement transducer configured to determine coordinates of the paint guns;

an electronic control unit (14) electrically connected to the linear actuator (7), wherein the electronic control unit (14) comprises:

an electronic gyroscope (19) configured to determine an angular speed of the vehicle on curved road sections, an electronic computation module configured to process signals received from said gyroscope and to generate signal values to be sent to a monitoring and control module, said monitoring and control module being configured to process signals received from said linear displacement transducer, said monitoring and control module comprising drivers configured to control said linear actuator and drivers configured to control a position of solenoid valves, said solenoid valves being configured to enable and disable the paint guns, and a near-sighting system comprising a laser scanner mounted in front of the marker unit and electrically connected to the electronic computation module, wherein the laser scanner emits a modulated beam and is configured to automatically identify coordinates of marking lines close to the paint guns, wherein the electronic computation module receives the coordinates of marking lines from the laser scanner, the electronic computation module being configured to automatically calculate a displacement between coordinates of the paint guns and coordinates of marking lines close to the paint guns, and based on said displacement, automatically send signal values to the monitoring and control module, said signal values controlling the position of said linear actuator and the position of said solenoid valves such that the paint guns automatically become positioned over corresponding marking lines, wherein the electronic control unit is further configured to calculate and automatically offset, based on the angular speed of the vehicle, for an additional deviation of the paint guns from the coordinates of any of the marking lines when the vehicle moves on curved road sections.

2. The device of claim 1, further comprising:

a far sighting system coupled with the near sighting system, the far sighting system comprising at least one digital video camera electrically connected to the electronic control unit, having an electronic image stabilization function and positioned so that the at least one digital video camera can capture an image of a stretch of road surface before an area scanned by the laser scanner, and a video signal processing module configured to process data coming from the at least one digital video camera to determine, prior to a laser scanner determination, a type of marking and coordinates of a marking line, said video signal processing module being electrically connected to the electronic computation module.

3. The device of claim 2, wherein a combination of the near-sighting system and the far-sighting system provides for an ability to restripe all marking lines having a wear rate of up to 90%.

4. The device of claim 1, wherein combination of said electronic control module, said monitoring and control module, and said laser scanner provides for an ability to restripe at a speed of 3 to 40 km/h.

5. The device of claim 1, wherein the laser scanner allows the device to operate under ambient lighting conditions.

6. The device of claim 1, wherein the laser scanner allows the device to operate in an absence of light.

7. The device of claim 1, wherein the device performs non-stop restriping of marking lines automatically via the electronic control unit and the laser scanner.

8. The device of claim 1, wherein the coordinates of marking lines comprise a start of a marking line, an end of a marking line, and a width of a marking line.

9. The device of claim 1, further comprising a control terminal, said control terminal being configured to toggle between at least two operation modes for the marker unit, said at least two operation modes comprising at least a first mode comprising re-striping of damaged marking lines and at least a second mode comprising applying a new standard marking to missing marking lines.

10. The device of claim 2, wherein the at least one digital video camera is positioned in front of the vehicle.

11. The device of claim 1, wherein the marker unit folds into a transport position such that none of its parts extend beyond the vehicle.

12. The device of claim 7, wherein the device travels at a speed of 3 to 40 km/h.

* * * * *